US006376785B1

(12) United States Patent
Graninger

(10) Patent No.: US 6,376,785 B1
(45) Date of Patent: Apr. 23, 2002

(54) REMOVABLE LATCH ASSEMBLY FOR AN ELECTRICAL SWITCH

(75) Inventor: Frank J. Graninger, Wind Lake, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/406,565

(22) Filed: Sep. 27, 1999

(51) Int. Cl.[7] ..... H01H 9/28
(52) U.S. Cl. ..... 200/50.02; 200/329
(58) Field of Search ..... 200/318.1, 321, 200/43.04, 43.11, 43.13, 50.01, 520, 341, 294, 293, 295, 229, 296, 329, 330, 332.1

(56) References Cited

U.S. PATENT DOCUMENTS 3,322,926 A * 5/1967 Mukai et al. ..... 200/168
3,392,598 A * 7/1968 Waldorf et al. ..... 74/483
4,249,057 A * 2/1981 Schlegel et al. ..... 200/296
4,766,277 A * 8/1988 Bigelow, Jr. ..... 200/293
5,401,925 A * 3/1995 Sambar ..... 200/296
5,420,387 A * 5/1995 Cummings ..... 200/524
6,198,058 B1 * 3/2001 Graninger et al. ..... 200/50.02

FOREIGN PATENT DOCUMENTS

EP 540073 A2 * 2/1992

* cited by examiner

*Primary Examiner*—Paula Bradley
*Assistant Examiner*—Nhung Nguyen
(74) *Attorney, Agent, or Firm*—Adam J. Forman; Alexander M. Gerasimow; William R. Walbrun

(57) ABSTRACT

A removable latch assembly is provided to connect a contact block to an electrical switch operator in an industrial controller. The latch assembly comprises a housing having a spring disposed therein, to which a rotatable collar is mounted. A contact block may also be connected to the rear side of the housing. The collar, including a tab, is initially disposed in a first locked position to allow the latch assembly to be mounted onto a shaft of the operator. The collar may then be rotated to a second self-retained unlocked position that allows the user to pull the latch assembly away from the electrical switch. When this occurs, the spring automatically rotates the collar back to the locked position to permit the latch assembly to once again connect the contact block to the operator.

21 Claims, 5 Drawing Sheets

REMOVABLE LATCH ASSEMBLY FOR AN ELECTRICAL SWITCH

BACKGROUND OF THE INVENTION

1. Field of the Invention

The invention relates to latch assemblies and, more particularly, relates to an improved method and apparatus for mounting a latch assembly onto, and disconnecting a latch assembly from, a switch operator.

2. Discussion of the Related Art

Electrical switches, such as pushbuttons or rotary switches used for the control of industrial equipment, are typically mounted on a front panel of a cabinet so that the manipulated portion of the switch (termed the "operator") projects out from and is accessible at the front of the cabinet.

For a pushbutton switch, a hole may be punched in the cabinet of sufficient diameter to accommodate the pushbutton and a surrounding threaded shaft. The shaft and pushbutton are inserted through the hole, and a threaded retaining nut is placed over the shaft and tightened to securely affix the switch to the panel. The panel is thus sandwiched between the switch body and the retaining nut.

The end of the switch operator protruding inside of the panel is connected or otherwise mounted onto one side of a latch assembly. Various contact blocks, depending on the particular configuration desired, may be bolted or otherwise mounted onto the other side of the latch assembly. The contact blocks are wired to the circuit or circuits that the switch is to control.

To conserve space on the panel and facilitate easy access to the operators by the attending user, several switches are located on the cabinet in close proximity. The spatial arrangement is usually limited by the size of the contact blocks on the back of the cabinet, which typically consume more space than the switch operators. However, with the contact blocks positioned in close proximity to each other, a technician must first remove the necessary contact block before various wiring operations may be performed.

Various approaches have been implemented in the past to enable the connection and disconnection of contact blocks from switch operators. These approaches typically involve mounting the contact block onto a housing having a secondary movable member that can be swiveled, lifted, or otherwise actuated to permit the disconnection of the contact block from the switch operator. However, several disadvantages are associated with these previous devices. First, the implementations can be difficult to use, as their operation is non-intuitive. Specifically, they require the continued actuation of the movable member by the user while removing the assembly from the operator. The user must therefore use two hands to disconnect the contact block from the switch operator, which can be quite difficult given the small amount of space with which to work between the contact blocks that are mounted on the panel. Additionally, once the contact block is disconnected from the operator, the movable member often must be actuated a second time either to permit reconnection of the contact block, and possibly a third time after reconnection to secure the contact block in connection with the operator. Additionally, if the contact blocks are insecurely connected to the switch operators and become dislodged, actuation of the switch operator does not have the desired effect on the controlled circuit. This results in stoppage of the controlled function or, if the switch is controlling, for example, an emergency stop function, more unfortunate results will ensue. Emergency stop (or E-Stop) functions are normally closed contacts that open when the operator is actuated. If the contact block becomes disengaged from the operator, then the controlled function would not stop when the operator is actuated, thereby resulting in malfunction. Additionally, the non-intuitive nature of the device's operation facilitates misuse by the user, which often leads to breakage of the device.

The need has therefore arisen to provide a latch assembly for connecting a contact block to a switch operator that can be mounted onto a shaft of the operator and subsequently removed with one hand, that prevents the unintentional disengagement of the contact block from the switch operator, and whose use is intuitive to the user.

OBJECTS AND SUMMARY OF THE INVENTION

It is therefore an object of the present invention to provide a latch assembly: 1) that allows a contact block to be easily connected to a switch operator, secured in the connected position, and subsequently disconnected from the operator, that comprises a self-retained locking mechanism that locks automatically upon insertion, thus minimizing the risk that the latch assembly will become unintentionally disengaged from the switch operator; 2) that may be operated with one hand; and 3) whose use is intuitive to the user.

It is a second object of the invention to provide a latch assembly that may be easily actuated in tight spaces to permit the user to perform various wiring operations to an associated contact block.

In accordance with a preferred embodiment of the invention, a latch assembly is provided that comprises a collar mounted onto a housing, and a spring disposed within the housing. The spring is inserted into an arcuate slot in the housing such that one end of the spring is biased against an extending arm of the collar. A contact block may be mounted to the rear face of the housing such that the latch assembly acts as an intermediary between the contact block and the switch operator to which it is mechanically connected. The switch operator includes a stem that passes through the latch assembly and mechanically engages and actuates a switch on the contact block.

The collar, when in a first, locked position, permits the mounting of the latch assembly onto a shaft of the switch. The collar may then be rotated to a second, self-retained, unlocked position, which permits the latch assembly to be removed from the shaft. Once the latch becomes disconnected from the shaft, the spring automatically rotates the collar back to the locked position.

While the latch assembly is being mounted onto the switch in its proper orientation, ensured by a key within the assembly, latch arms on the collar that extend downwardly into the housing are aligned with slots on the shaft of the switch. As the assembly receives the shaft, the latch arms engage the slots until they slide over bottom lips of each slot, thereby forming an interference fit between the latch arms and the slots, and retaining the switch inside the assembly.

Before the latch assembly is removed from the switch, the collar is first rotated to the self-retained, unlocked position. When this occurs, the extending arm of the collar compresses the spring. Additionally, while the collar is rotated, the latch arms slide radially from the slots onto respective smooth surfaces of the shaft. Because the distance between the smooth surfaces is greater than the distance between the two latch arms, the latch arms become deflected radially outward from their normal position when the collar is rotated to the unlocked position. As a result, a finger of one of the latches interferes with a catch disposed within the housing. Although the spring is compressed and provides a force onto the extension arm and towards the collar's first position, the user may nonetheless let go of the collar as the interference between the finger and the catch prevents the collar from returning to its locked position while the shaft is disposed within the latch assembly. Additionally, when the latch arms are disposed on the respective smooth surfaces adjacent the slots, the latch arms ride axially along the smooth surfaces as the assembly is removed from the shaft. The collar will stay in place without the interference with the finger and the catch due to the frictional forces between the latch arms and the shaft and the collar and housing. However, the interference adds to the insurance that the collar will be retained in its proper orientation.

Once the latch assembly is dismounted from the shaft, the latch arms return to their normal position, thereby becoming disposed radially inward of the catch in the housing and alleviating the interference that was retaining the collar in its unlocked position. The spring then releases, applying a force to the extending arm of the collar and rotating the collar once again to its locked position, where the assembly is again ready to be mounted onto another shaft. Walls in the collar butt against walls in the housing to prevent the over-rotation of the collar in its locked and unlocked positions.

Additionally, in accordance with a preferred embodiment of the invention, the collar has an extending tab that protrudes upwardly away from the contact block. Therefore, to rotate the collar, the user may either rotate the tab by hand, or, because the tab includes accessible grooves, the user may apply a force to the tab using one of many possible tools to rotate the collar. Once the collar is rotated, the user may then pull the latch assembly off of the shaft, thereby returning the collar to its locked position, where the latch assembly may be once again mounted onto a shaft, as previously described.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes ail such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Pursuant to the invention, a latch assembly for connecting a contact block to a switch operator of an electrical switch is provided. The latch assembly preferably comprises a rotatable collar that is mounted onto a housing, and a spring that is disposed within the housing, and that biases an arm of the collar. The collar includes upper and lower latch arms that protrude generally downwardly into the housing. When the collar is in a locked position, the latch assembly may be mounted onto a shaft of the electrical switch, thereby creating an interference fit between the latch arms and slots on the shaft. To remove the latch assembly from the shaft, the collar is then rotated to a self-retained, unlocked position, thereby rotating the latch arms to a smooth surface on the shaft adjacent the slots and relieving the interference fit with the slots. The latch assembly may then be removed from the shaft. Once the latch assembly is removed, the spring automatically rotates the collar back to the locked position, where the latch assembly may once again be mounted onto a shaft.

Figure 1:
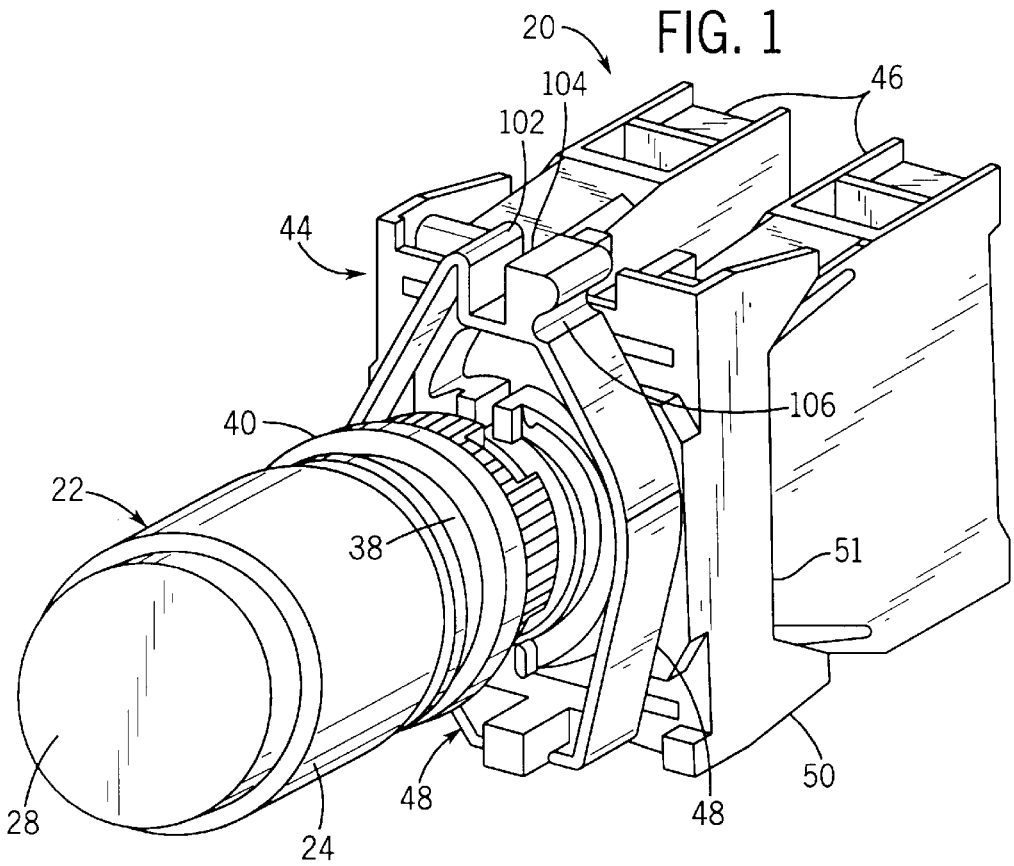
FIG. 1 is a perspective view of a latch assembly connecting a contact block to a switch operator in accordance with a preferred embodiment of the present invention.
Figure 2:
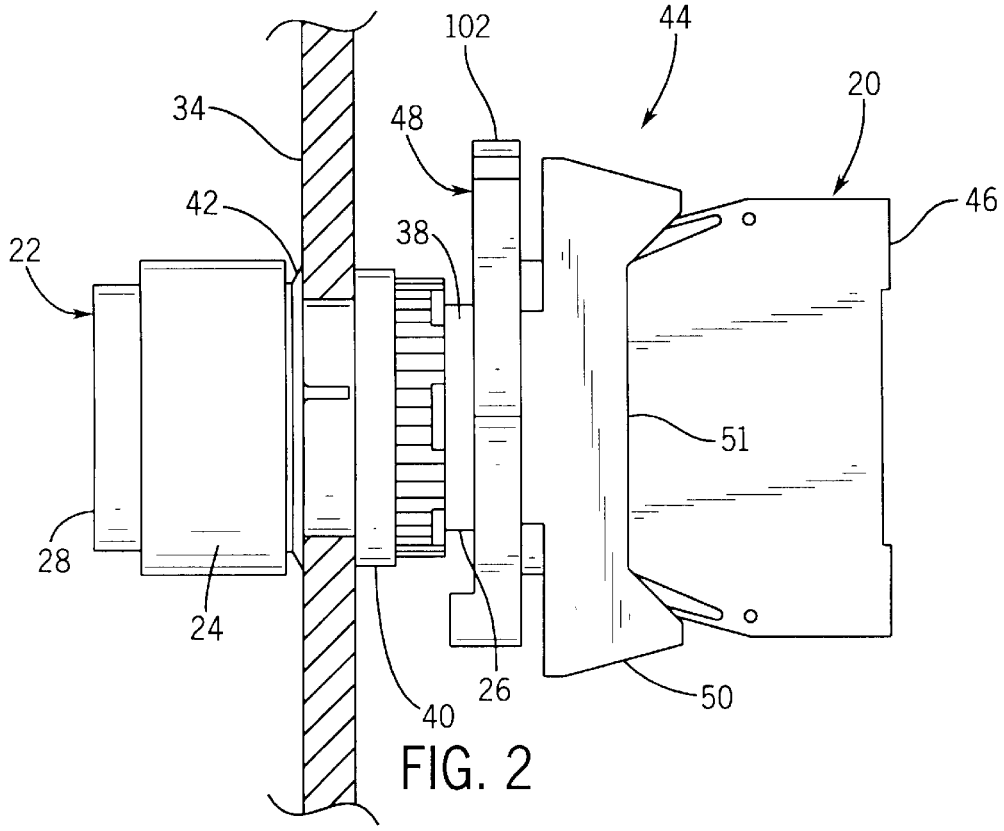
FIG. 2 is a side elevation view of the latch assembly, operator, and contact block of FIG. 1.
Figure 3:
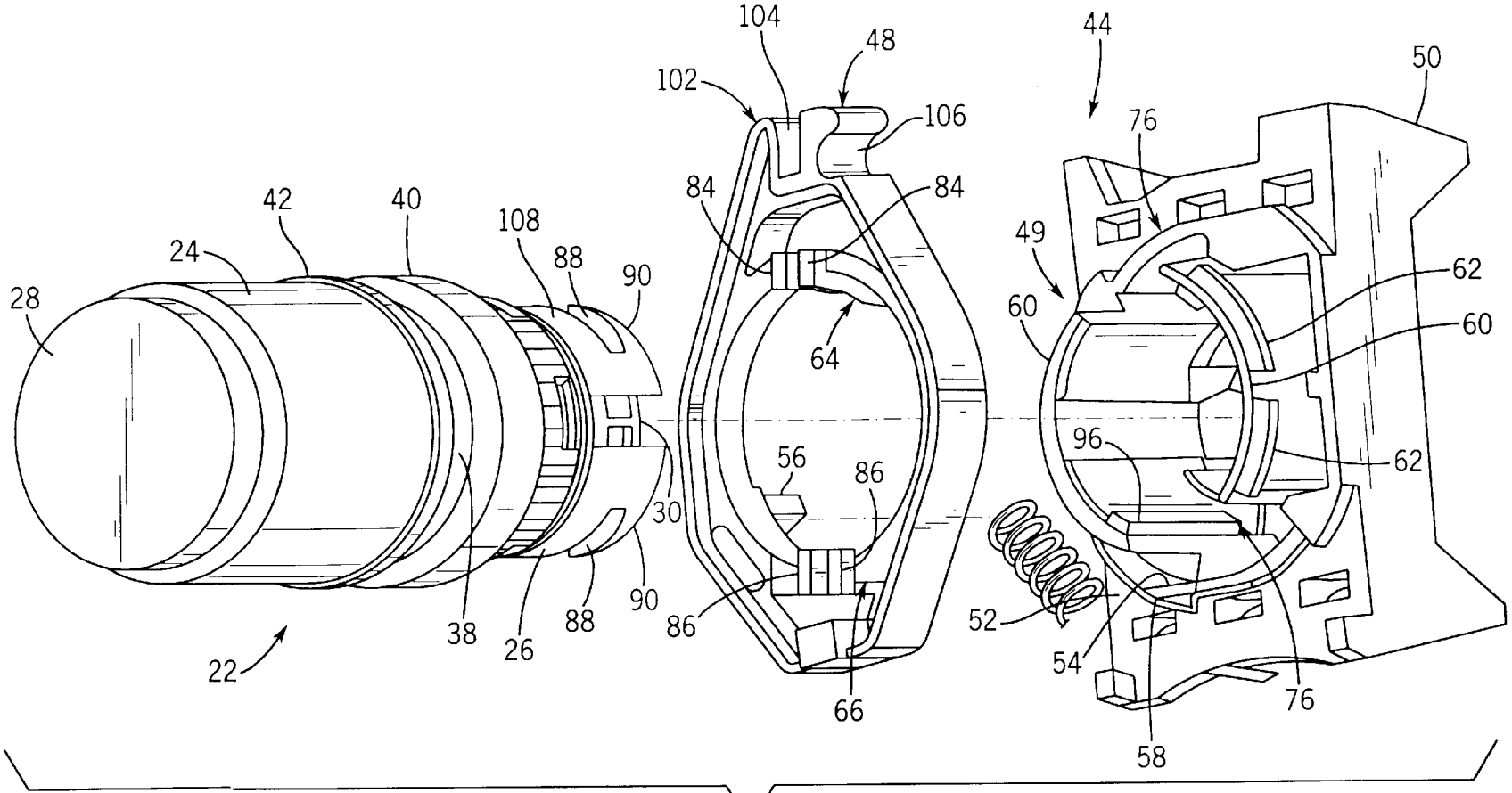
FIG. 3 is an exploded perspective view of the latch assembly and operator of FIG. 1.

Referring initially to FIGS. 1–3, an electrical switch 20 includes an operator 22 having a head 24 at one end of a cylindrical shaft 26. The head 24 may include a pushbutton 28 or any other manually operated member. The pushbutton 28 attaches to a stem 30 passing generally inside the shaft 26 to communicate the action of the pushbutton 28 to a connected contact block 46 of a set of contact blocks. The stern 30 of the pushbutton 28 is biased outward by a spring 32 (shown in FIG. 6) which may be custom tailored to the particular type of operator being employed.

Figure 6:
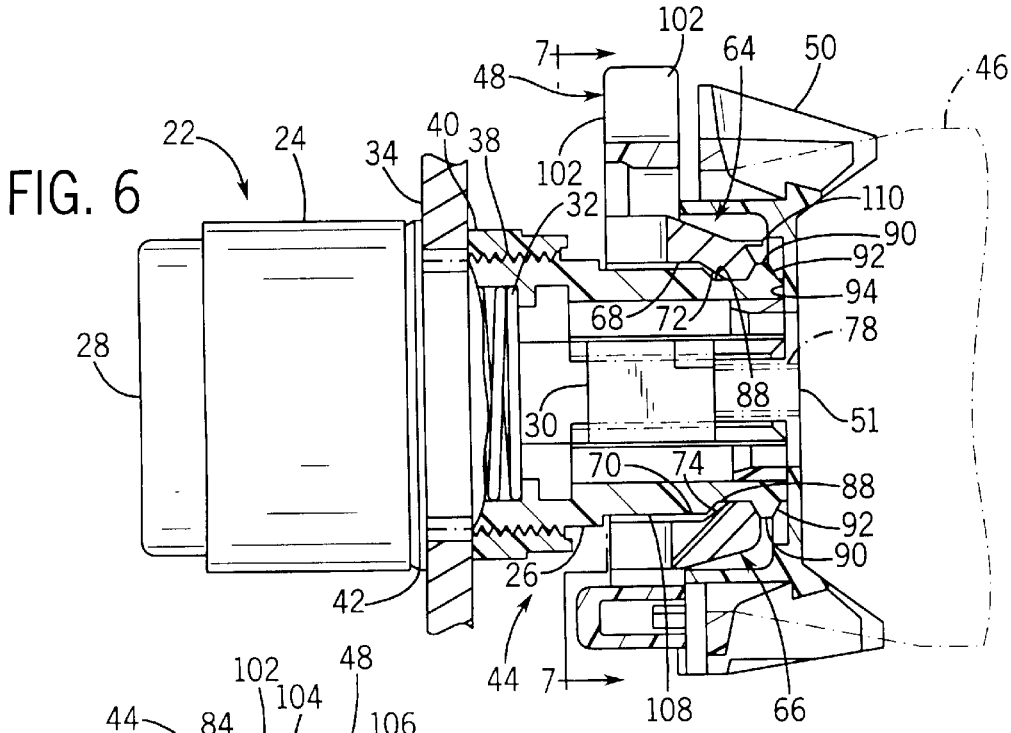
FIG. 6 is a sectional side elevation view of the latch assembly mounted onto the shaft and contact block.

A sheet panel 34, preferably made of sheet metal, has a hole (not shown) for receiving the shaft 26. External threads 38 are formed on the portion of the shaft 26 passing through the hole. The head 24, remaining on the outside of the panel 34 when the shaft 26 is inserted into the hole, is drawn against the panel by a nut 40, placed over the shaft inside of the panel and tightened on the threads 38. The panel 34 is thus sandwiched between the nut 40 and an inner face of the head 24. An elastomeric washer 42 may also be positioned between the head 24 and the panel 34 on the outside of the panel to provide a seal against the outside environment. As shown in FIG. 6, the portion of the shaft 26 displaced from the head 24 and passing through the panel 34 is received by a latch assembly 44. A mechanical interface is enabled to receive a plurality of operators to connect them to the contact blocks. As a result, while an electrical switch comprising a pushbutton in accordance with the preferred embodiment of this invention has been described, it should be noted that any type of switching mechanism, having an operator and a shaft that is compatible with a latching assembly in accordance with an embodiment of the present invention, may be used.

Figure 4:
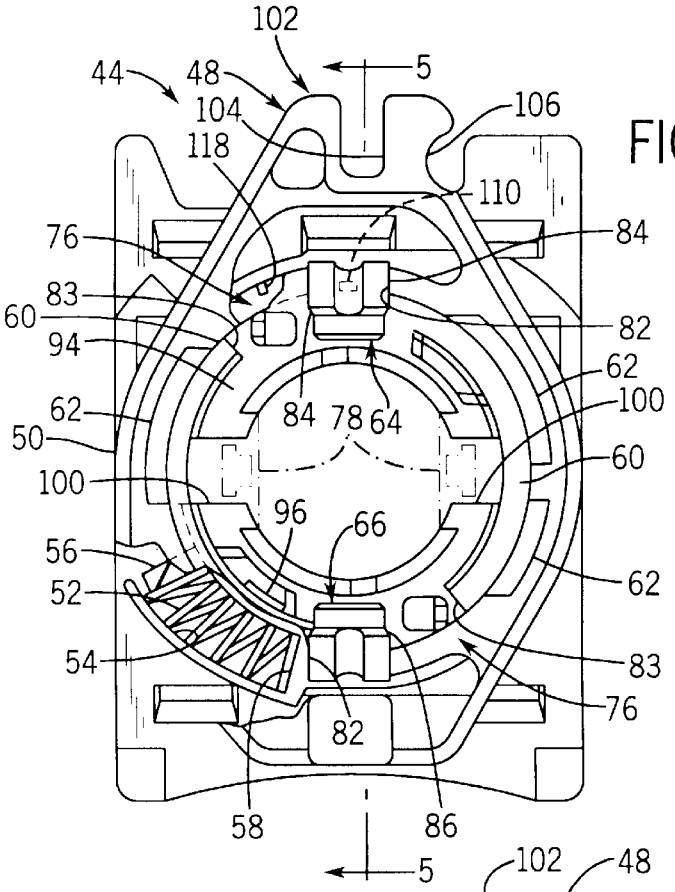
FIG. 4 is a sectional front elevation view of the latch assembly and contact block with a portion of the collar being cutaway.

Referring to FIG. 3, the latch assembly 44 comprises a housing 50 and a rotatable collar 48 that is mounted onto a front face 49 of the housing 50. A spring 52 is inserted into an arcuate slot 54 in the housing 50. One end of spring 52 is seated against an arm 56 extending generally downwards from the collar 48, and the other end is seated against an inner wall 58 of the slot 54. The collar 48 is mounted onto a generally cylindrical sleeve 60 in the front face 49 of the housing 50. The sleeve 60 has a set of flanges 62 to prevent the collar 48 from moving axially with respect to the housing 50. The collar 48 has an upper latch arm 64 and a lower latch arm 66 that include: 1) respective axial members 68 and 70 extending generally downward into the housing 50; and 2) respective radial members 72 and 74 extending generally downward and radially inward of the generally cylindrical sleeve 60 (better shown in FIG. 5). (The terms "axial" and "radial" are used herein for the sake of convenience to designate directions of extension and movement because the collar and sleeve are generally cylindrical. However, these terms should not be construed to exclude a non-cylindrical design. Hence, for example, "axial" should be construed to be synonymous with "longitudinal.") When the collar 48 is initially inserted into the housing 50, the spring 52 biases the arm 56, thereby rotating the collar around the sleeve 60 and into a locked position, wherein the assembly 44 can be mounted and locked onto the shaft 26, as shown in FIG. 4. While a standard metallic coil spring is used in accordance with the preferred embodiment of the invention, any spring comprising resilient material flat is capable of rotating a collar in accordance with the preferred embodiment may be used. Furthermore, while the spring in accordance with a preferred embodiment comprises a separate element, the spring could be part of the housing or collar in alternate embodiments. The generally cylindrical sleeve 60 contains two gaps 76, defined by outer walls 82 of the sleeve. Walls 84, 86 of the latch arms 64, 66 butt against the outer walls 82 when the collar 48 is in the first position, thereby preventing the spring 52 from further rotating the collar beyond the first position.

Figure 7:
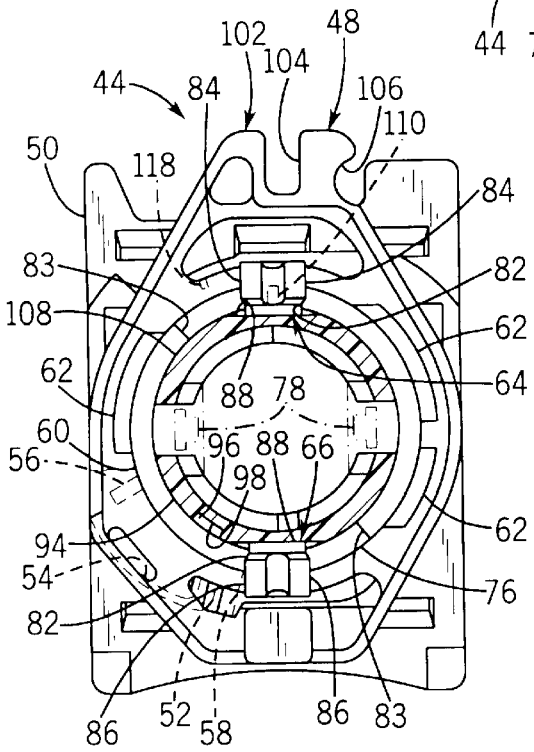
FIG. 7 is a sectional front elevation view of the latch assembly, contact block, and shaft, taken generally along lines 7—7 of FIG. 6 with the collar in a locked position.

Once the collar 48, housing 50, and spring 52 are assembled, as shown in FIGS. 6 and 7, contact block 46 may be mounted onto the rear face 51 of the housing so that the stem 30 of the operator 22, passing through the collar 48 and housing, actuates buttons 78 in the contact block when depressed. The rear face 51 of the housing 50 includes threaded bosses (not shown) which are used to attach the contact block 46 to the housing with machine screws (not shown).

Figure 5:
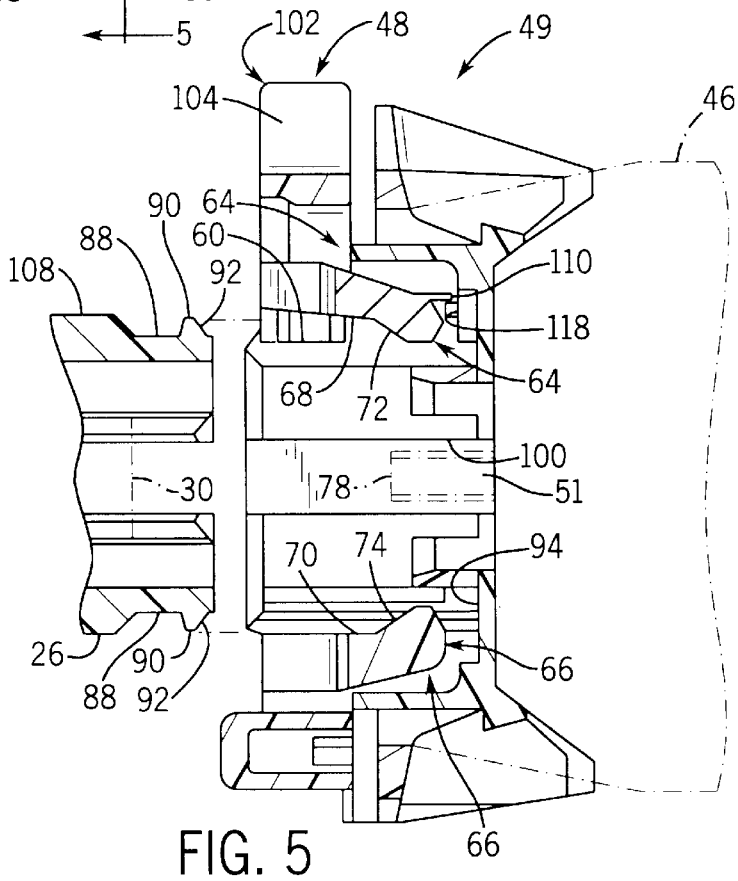
FIG. 5 is a sectional side elevation view of the latch assembly, contact block, and a shaft of the operator, taken generally along lines 5—5 of FIG. 4.

As shown in FIGS. 4 and 5, the collar 48 is initially disposed in the first locked position when the latch assembly 44 is assembled, and also when the assembly is in its free state and not mounted onto the shaft 26. The shaft 26 includes two insertion slots 88 near the bottom of the shaft, with an outwardly displaced bottom lip 90 disposed at the base of each slot. As the latch assembly 44 is mounted onto the shaft 26, the radial members 72, 74 of each latch arm 64, 66, rounded at the bottom, cam up over the bottom portions 92 and over the lips 90, thereby creating an interference fit with the associated slot 88. Because the distance between the bottom lips 90 is greater than the distance between the radial members 72, 74, the latch arms 64, 66 deflect radially outward from their relaxed positions as the assembly 44 is mounted onto the shaft 26. However, once the radial members 72, 74 ride over the bottom lips 90 and snap down into the slots 88, the latch arms 64, 66 revert to their relaxed positions. The interference between the bottom lips 90 and the radial members 72, 74 now disposed in the slots 88, prevents the shaft 26 from unintentionally becoming disconnected from the assembly 44, thereby locking the shaft in place. A floor 94 in the housing 50 butts up against the end of the shaft 26, thereby preventing the latch assembly 44 from being mounted too far onto the shaft. Additionally, the housing 50 includes a longitudinal key 96 that fits into a longitudinal keyway 98 on the shaft 26 (shown in FIG. 7). This ensures that the latch assembly 44 is properly orientated with respect to the shaft when it is mounted onto the shaft 26, and prevents rotation of the shaft when disposed inside the assembly.

The key 96 and keyway 98 are first generally aligned so that when the contact block 46 is mounted onto the housing 50, it need be only slightly rotated to permit the latch assembly 44 be mounted onto the shaft 26. The assembly 44 is mounted onto the shaft 26 with the collar 48 in the locked position so that the radial members 72, 74 slide over the associated beveled edge 92 of the lip 90 and lock into the slot 88. The housing 50 also comprises two additional indents 100 to receive the stem 30 (shown in FIG. 4).

Figure 8:
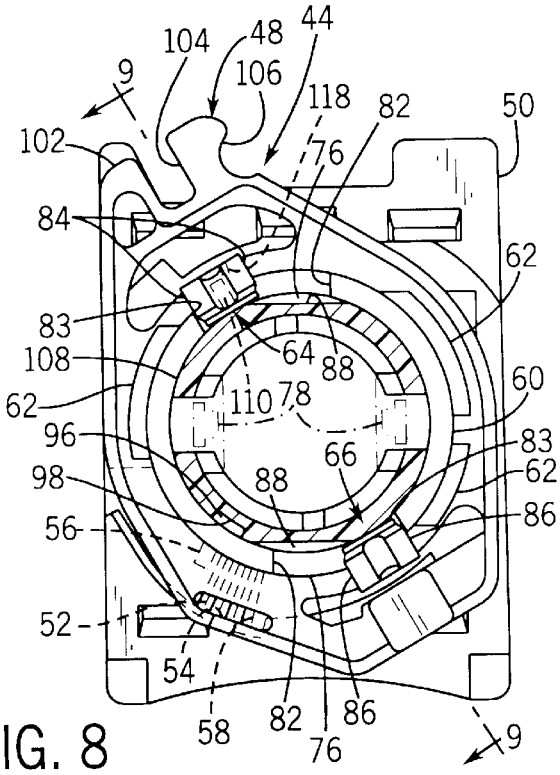
FIG. 8 is a sectional front elevation view of the latch assembly, contact block, and shaft.
Figure 9:
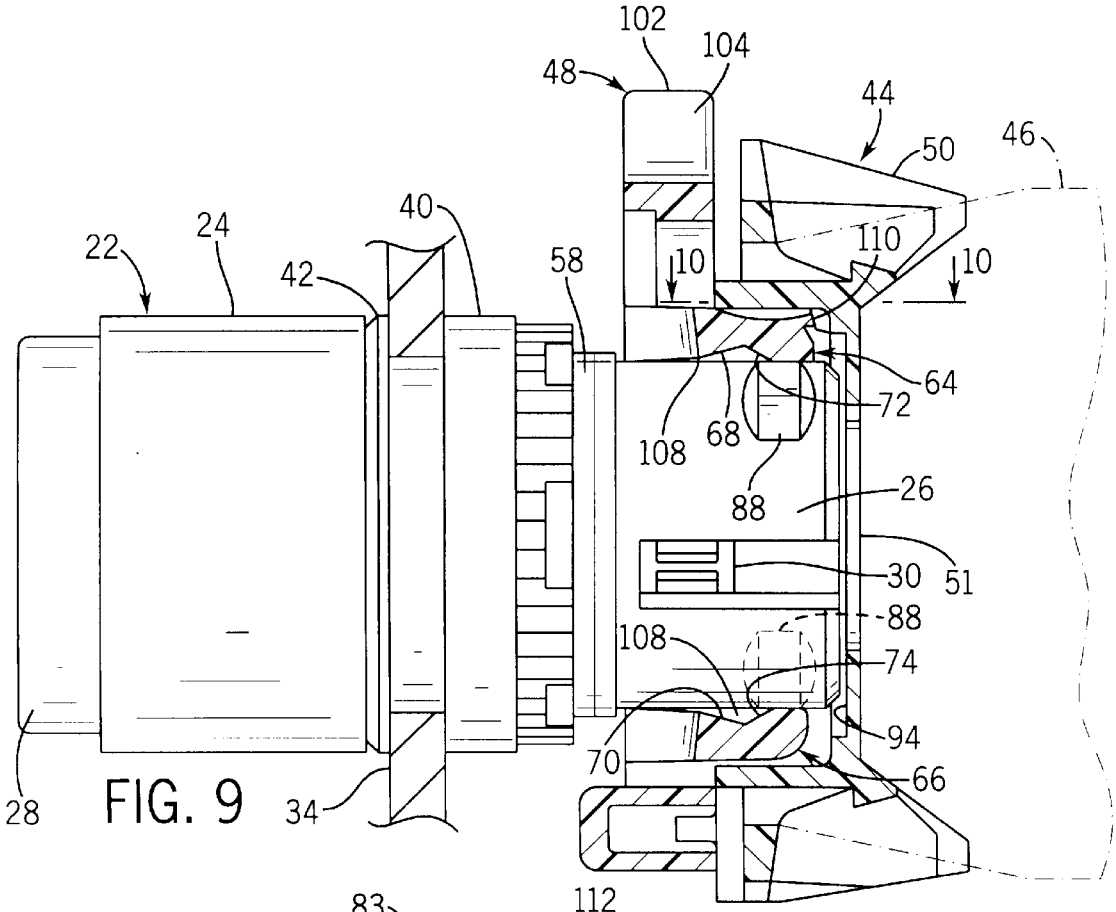
FIG. 9 is a sectional side elevation view of the latch assembly, taken generally along lines 9—9 of FIG. 8.

As shown in FIGS. 8 and 9, to remove the latch assembly 44 from the switch 20, the collar 48 is first rotated to a second self-retained unlocked position by applying a radial force to a tab 102 that extends in a generally upward direction from the collar 48. The tab 102 includes a generally rectangular groove 104 as well as a semicircular notch 106, so that a user may rotate the tab with his or her hand, or with any tool capable of fitting within the groove 104, thereby rotating the collar 48. The walls 84, 86 of the latch arms 64, 66 butt against the outer walls 83 when the collar is in the second position thereby preventing the over-rotation of the collar. The latch assembly 44 may then be dismounted from the shaft 26, thereby disconnecting the associated contact block 46 from the operator 22 when the collar 48 is in the unlocked position.

As the collar 48 is rotated to the unlocked position, the latch arms 64, 66 ride radially along the insertion slots 88 on the shaft 26 towards respective smooth surfaces 108 adjacent each slot until the collar is fully rotated to the unlocked position, wherein the latch arms are disposed on the smooth surfaces. Once the collar 48 is fully rotated to the unlocked position, the latch arms 64, 66 no longer interfere with the slots 88 on the shaft 26. As a result, the latch assembly 44 may be pulled free from the shaft 26. As this occurs, the latch arms 64, 66 ride along their respective smooth surfaces 108, guided by the longitudinal key 96 in the housing 50 and keyway 98 in the shaft 26. Because the smooth surfaces 108 are disposed radially outward from the slots 88, (and are also therefore disposed radially outward from the radial members 72, 74) the latch arms 64, 66 become radially outwardly displaced when the collar 48 is rotated.

Additionally, while the collar 48 is rotated, the extending arm 56 in the collar compresses the spring 52 (shown in FIG. 8). As a result, the collar 48 is spring loaded when it is in the unlocked position. Interference between the upper latch arm 64 and a catch 118 in the housing 50 prevents the spring 52 from releasing and forcing the collar 48 to rotate back to the locked position, as will be described.

The "collar" as used in the preferred embodiment of this invention should not be so narrowly construed as to merely constitute a device that mounts on a circular shaft and rotates from one position to another. Rather, "collar" is intended to include any element that may be mounted onto a housing and is movable from a first position permitting the assembly to receive a housing, to a second position permitting the assembly to be released from the housing, wherein the element is self retained in the second position.

Figure 10:
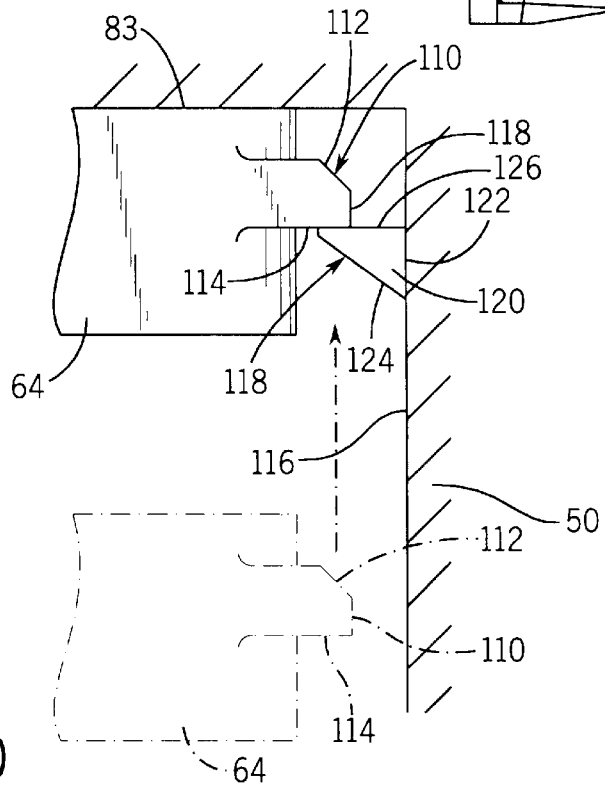
FIG. 10 is a sectional top elevation view of the latch assembly, taken generally along lines 10—10 of FIG. 9.

Referring now also to FIG. 10, the upper latch arm 64 includes a finger 110 extending generally downwardly. The finger 110 has a beveled first wall 112 and a straight second wall 114 that is generally parallel with the axial member 68 of the upper latch arm. An inner wall 116 of the housing 50 contains the catch 118, which comprises a protrusion 120 extending generally upwardly from a base 122 in the housing end wall 83. The protrusion 120 is generally triangularly shaped, having an inner beveled wall 124 and an outer wall 126. When the upper latch arm 64 is deflected radially outward from its relaxed position, it is radially aligned with the catch 118. As the collar 48 is rotated, the upper latch arm 64 moves in the direction of the arrow in FIG. 10, and the first wall 112 of the finger 110 engages the beveled wall 124 of the catch 118. As the collar 48 is further rotated, the finger 110 rides up along the protrusion 120 until it snaps down into the catch 118, thereby creating an interference fit and retaining the collar in the unlocked position.

Once the latch arms 64, 66 become disengaged from the shaft 26, they return to their non-deflected relaxed positions, as shown in FIG. 5. As a result, the finger 110 becomes radially inwardly disposed of the protrusion 120 of the catch 118 in the housing 50, thereby alleviating the interference that was retaining the collar 48 in the unlocked position. Once this interference disappears, the spring 52 forces the arm 56 in the collar 48 toward the locked position (shown in FIG. 4), thereby allowing the latch assembly 44 to once again be mounted onto the shaft 26.

Once the collar 48 is in the self-retained unlocked position, the user is able to let go of the tab 102 and remove the latch assembly 44 from the shaft 26 with one hand. Because the latch assembly 44 then automatically reverts to its locked position, the user may then once again mount and lock the latch assembly onto the shaft 26 without further manipulation of the latch assembly. Additionally, because the latch assembly 44 need not be actuated to mount and lock it onto the shaft 26, the risk of unintentionally dismounting the assembly from the shaft, thereby disconnecting the contact block 46 from the operator 22, is minimized. The overall safety of the assembly is thereby increased.

Many changes and modifications may also be made to the invention without departing from the spirit thereof. The scope of these changes will become apparent from the appended claims.

I claim:

1. A latch assembly for connecting a contact block to a switch operator, said latch assembly comprising:

a housing having a first side connectable to the contact block and a second side opposite said first side;

a spring; and a movable collar mounted onto said second side of said housing, said collar having a first position and a self-retained spring-compressed second position, wherein said spring biases said collar from said second position to said first position when said latch assembly is not mounted onto a shaft of the operator.

2. The latch assembly of claim 1, wherein said second position is an unlocked position, and wherein said latch assembly is releasable from the shaft of the operator when said collar is in said second position.

3. The latch assembly of claim 2, wherein said first position is a locked position, and wherein said latch assembly is mountable onto the shaft when said collar is in said first position.

4. The latch assembly of claim 3, wherein said collar includes an arm which compresses said spring and is drivable by said spring to move said collar from said unlocked position to said locked position.

5. The latch assembly of claim 1, wherein said collar comprises a latch arm, said latch arm receiving a slot in the switch when said latch assembly is mounted on the shaft.

6. The latch assembly of claim 5, wherein:

said latch arm is disposed radially outward when said collar is rotated from said first position to said second position;

said latch arm includes a protrusion; and said housing includes a catch that receives said protrusion when said collar is rotated from said first position to said second position.

7. The latch assembly of claim 6, wherein said protrusion is configured to be disposed radially inward of said catch upon removal of said latch assembly from the shaft, thereby releasing said spring to return said collar to said first position.

8. The latch assembly of claim 7, wherein said latch assembly is keyed to permit said housing to be mounted onto the shaft in only a single proper orientation.

9. A latch assembly for connecting a contact block to a switch operator, said latch assembly comprising:

a housing having a first side connectable to the contact block and a second side opposite said first side;

a lockable collar mounted onto said second side of said housing, said collar having a first, locked position permitting said latch assembly to be mounted onto a shaft of the operator, and a second, unlocked position permitting said latch assembly to be released from the shaft, said collar automatically returning to said locked position from said unlocked position when said latch assembly is released from the shaft.

10. The assembly of claim 9, wherein said latch assembly further comprises a spring disposed in said housing, and wherein said spring biases said collar from said unlocked position toward said locked position.

11. The assembly of claim 10, wherein said collar comprises a latch arm having a protrusion that is inserted into a catch disposed in said housing adjacent an inner wall thereof to hold said collar in said unlocked position when said latch assembly is mounted onto the shaft.

12. The assembly of claim 9, wherein said collar comprises a latch arm that biases against a slot in the shaft to hold the switch in the latch assembly when the latch assembly is mounted onto the shaft and when said collar is in said locked position.

13. The assembly of claim 12, wherein said latch arm is rotatable away from said slot when said collar is moved to said unlocked position to permit the latch assembly to be disengaged from the switch.

14. A method comprising:

connecting a collar of a latch assembly to a housing of said latch assembly;

mounting said latch assembly onto a shaft of a switch operator when said collar is in a locked position;

moving said collar to a self-retained unlocked position; and removing said latch assembly from the shaft when said collar is in said unlocked position, wherein said collar automatically returns to said locked position after said removing step is complete.

15. The method of claim 14, wherein said moving step comprises:

deflecting a latch arm of said collar outwardly; and inserting a protrusion of said latch arm into a catch disposed on said housing to hold said collar in said unlocked position.

16. The method of claim 15, wherein, after said removing step, a spring disposed in said housing forces said collar to rotate from said unlocked position to said locked position.

17. The method of claim 16 wherein, after said removing step, said protrusion is returned to a position located radially inward of said catch, thus permitting said spring to force said collar to move to said locked position.

18. The method of claim 14, wherein said mounting step further comprises inserting a latch arm of said collar into a slot on the shaft, thereby retaining the shaft in the latch assembly.

19. The method of claim 18, wherein said rotating step comprises rotating said latch arm away from the slot, thereby permitting said latch assembly to be released from the shaft.

20. An electrical switch assembly for a control circuit comprising:

a contact block configured to transmit electrical signals to an output device;

a switch operator having a stem that may be actuated to establish an electrical connection between an input of the contact block and the output device; and a latch assembly having a first side connected to the contact block, and having a second side connected to a shaft of said switch operator, said latch assembly comprising a housing having a slot formed therein, a spring disposed in said slot, and a collar mounted on said housing, said collar having an extending member biased by said spring, wherein said collar is rotatable from a locked position to an unlocked position, thereby compressing said spring and permitting removal of said latch assembly from the shaft, and wherein said spring is released when said latch assembly is removed from the shaft, thereby rotating said collar from said unlocked position to said locked position and permitting said latch assembly to be mounted onto the shaft.

21. The electrical switch assembly of claim 20, wherein a mechanical interface between said latch assembly and said switch operator is standardized to permit a plurality of different types of switch operators to be mechanically coupled to said latch assembly.

* * * * *